United States Patent [19]

Helm et al.

[11] Patent Number: 4,743,024

[45] Date of Patent: May 10, 1988

[54] AMUSEMENT ARCADE MACHINES FOR USE IN AMUSEMENT AND/OR GAMING OR THE LIKE

[75] Inventors: Arthur E. Helm, Southport; Stuart J. Keane, Leeds, both of England

[73] Assignee: Elton Fabrications Limited, Merseyside, England

[21] Appl. No.: 805,700

[22] Filed: Dec. 6, 1985

[30] Foreign Application Priority Data

Dec. 8, 1984 [GB] United Kingdom ..... 8431070

[51] Int. Cl.[4] ..... A63F 5/04

[52] U.S. Cl. ..... 273/143 R; 273/138 A

[58] Field of Search ..... 293/138 A, 143 R

[56] References Cited

U.S. PATENT DOCUMENTS 4,184,683 1/1980 Hooker ..... 273/143 R
4,200,291 4/1980 Hooker ..... 273/143 R

FOREIGN PATENT DOCUMENTS 581358 10/1976 Switzerland .
619372 9/1980 Switzerland .
1359852 7/1974 United Kingdom .
1553117 9/1979 United Kingdom .
1568522 5/1980 United Kingdom .
1591623 6/1981 United Kingdom .
2137392 3/1984 United Kingdom .

OTHER PUBLICATIONS

PCT Application WO80/02512, Krause, "*Computerized Gaming System*", 10/4/80.

*Primary Examiner*—Leo P. Picard
*Attorney, Agent, or Firm*—Fred Philpitt

[57] ABSTRACT

The machine is a coin operated gaming machine wherein at each play random number display devices is actuated a plurality of times and a number corresponding to the number displayed by the random display device at each actuation is illuminated in a display matrix of the machine containing all numbers, the objective being at each play to win by illuminating a row of numbers or the four corner numbers in the display matrix. Winnings are in the form of tokens dispensed from the machine and the tokens can be exchanged for gifts contained in a display case forming part of the machine casing.

11 Claims, 3 Drawing Sheets

AMUSEMENT ARCADE MACHINES FOR USE IN AMUSEMENT AND/OR GAMING OR THE LIKE

This invention relates to machines for use in amusement and/or gaming or the like, referred to herein as amusement machines for simplicity. Such machines are commonly used in arcades, but it is to be pointed out that they can be used in social clubs, public houses and other locations providing entertainment for the public. These machines can also be used in fairgrounds and carnival parks.

The present machine is an attempt to direct attention away from the more traditional type of amusement machine which employs simply gambling techniques involving the insertion of a coin, an operation of the machine, and the payout in cash if the operation of the machine results in a win. The most popular of these machines comprises the so called fruit machine which has a plurality of drums or reels with symbols on the peripheries thereof. The reels spin when the machine is operated, and depending upon the combination of symbols displayed in a window through which the player can view the drums, so a winning line or not is displayed. These machines have additional functions such as "nudge" "hold" and "free re-spin" and so on, but essentially the operation involves the insertion of a coin, spinning of the discs resulting in the random display of a line of symbols, the objective being to achieve the display of a winning line of symbols. A whole range of cash winnings from 10p to 100 may be available.

There is some social concern that these machines as they involve simply gambling with cash, are undesirable, as frequently they are played, and sometimes played to excess, by young people who cannot afford to lose money on gambling.

The present invention concerns a machine which will provide amusement and entertainment and also prizes if appropriate, but will lessen or reduce the intrinsic gambling aspect of the more conventional machines.

Additionally, the machines of the present invention can be ganged so that they can be used by a group of players, one per machine, the players playing against each other with the aim of reaching an objective before the other players.

The present invention is based on the well known game of bingo which is very popular and socially acceptable. Bingo comprises essentially the marking of a card containing a plurality of numbers in accordance with the random selection of numbers by a machine, or by drawing same, the objective being that the first person to mark off the numbers or numbers arranged in a certain way on the card wins the prize, which may be cash. The particular ways of achieving a win may comprise completing a line of numbers or completing the numbers at the four corners of the card. Completing all the numbers of the card is known as a full house. Typically a card will contain fifteen numbers out of the possible numbers 1 to 90, therefore it does take some time before a full house or a winning arrangement of numbers is achieved, thereby providing prolonged entertainment for the players and more "value for money".

In the present invention, the machine is provided with a matrix of numbers or symbols or the like displayed in front of the player, the matrix being for example a five by five matrix indicating the numbers 1 to 25, and the machine is operated by the player to operate random number symbol or the like display means, the random display means and the matrix being interlinked to provide an indication in relation to the matrix when a number or symbol or the like displayed by the random display means corresponds to that number or symbol or the like in the matrix, the objective being to achieve the indication of particular numbers or symbols or the like in the matrix for the winning of a prize.

Preferably, the matrix displays a plurality of numbers and the random display means displays numbers.

The random number display means may comprise a pair of rotatable drums with numbers on the respective peripheries. When the display matrix is a five by five, containing the numbers 11 to 55, each drum has only the numbers 1;2;3;4 and 5 so that in each operation of the machine following the spinning of the drums, a number in the display matrix will be displayed by the drums. When that number is displayed it may be arranged that the number in the display matrix will be illuminated or otherwise indicated, indicating that that number has been displayed by the drums.

In a preferred arrangement, the player inserts a coin for which he has a plurality of operations of the machine, say seven, and his objective is to achieve the highest prize by the illumination of five of the numbers in the matrix in a line which may be horizontal or vertical, or may be a diagonal, or by illuminating each of the four corner numbers and as an alternative, he will be given a smaller prize for illuminating any one of the corner numbers, or other number combinations. The machine preferably is arranged to payout tokens depending upon the win achieved, and such tokens are exchangeable for gifts having different token ratings. The player may operate the machine repeatedly with the objective of achieving a higher accumulation of tokens than can be achieved by one operation of the machine, and it should be borne in mind that in this example, an operation of the machine comprises seven numerical displays of the drums, and in such seven displays the same numbers may be displayed twice or more by the random display means by of course the said number can only be illuminated once and display of the same number twice means of loss of a turn to the player.

It is preferred that at any time the player can hold either drum from spinning should he desire to retain the numeral displayed by that drum for the next spin of the drum. Thus, if the player requires the number 18 to complete a line, and at one spin of the drum the number 15 is displayed, he can hold the numeral 1 on the first drum, and spin only the second drum at the next spin operation.

Additionally, each drum may be associated with a "skill spin" feature by which the player can judge when to stop each reel in an attempt to stop each reel in a position displaying a required number.

The machine may be handle or push-button operated, and it is preferably constructed so as to have a top portion with the matrix of numbers, an intermediate glass display case portion displaying the prizes which can be won and the number of tokens required to win same, and the lower portion comprising the operating handle, the machine mechanism and the display windows for the drums.

In an arrangement where a plurality of machines are ganged so as to operate together, and so that players play against each other, the ganging will be such that as soon as one of the players achieves a particular result, say the illumination of a line of numbers, all other machines will automatically stop, and the person with the winning line will be the winner. In this arrangement, there is no limit on the number of spins of the drums, the objective being that once the game with all the players has started, the spinning of the drums takes place until a winning conclusion is reached.

Conventional mechanical, electrical and electronic mechanisms are used for the operation of the machines, and such mechanisms are not described herein in detail as it is well within the knowledge of persons skilled in the art to provide the operating mechanism for a machine or gang of machines in accordance with the present invention.

It is also to be mentioned that the machines of the invention can be used for providing cash payout instead of tokens, but it is felt that the embodiment comprising the payout of tokens which are exchanged for prizes which are on display adds to the appeal of the machine.

Simply by way of example, a machine according to the invention is illustrated diagrammatically in the accompanying drawings wherein.

Figure 1:
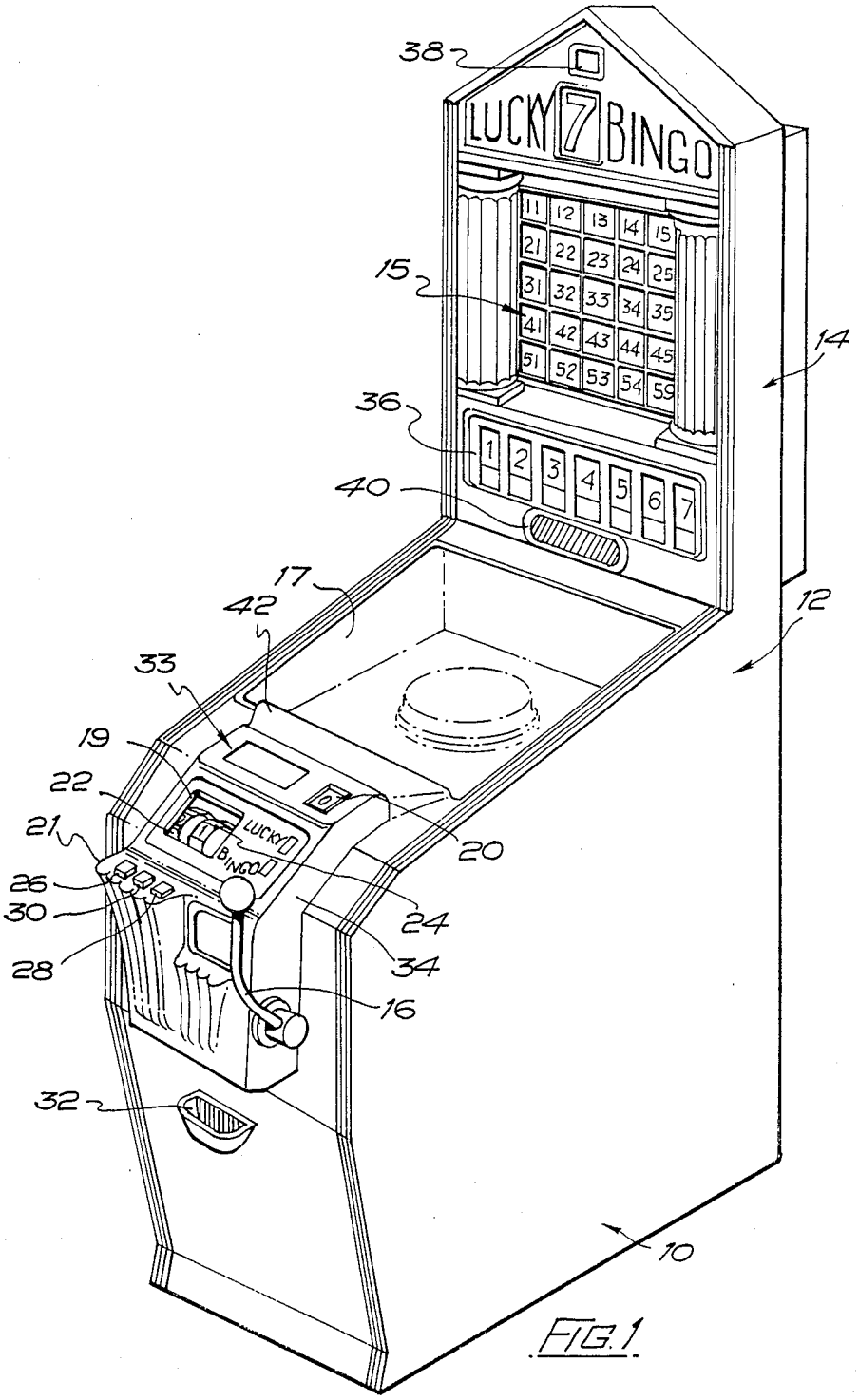
FIG. 1 is a perspective view of the machine.

Referring to the drawings, the machine illustrated comprises a casing 10 which is tapered upwardly and rearwardly as indicated by reference 12 and leads to a rear display panel 14 which carries a matrix of numbers (11 to 55 in this example) indicated by reference numeral 15. The machine is operated by means of a handle 16, and the case embodies a display area 17 closed by a transparent sheet, and in which prizes which can be won by operation of the machine are displayed.

Figure 2:
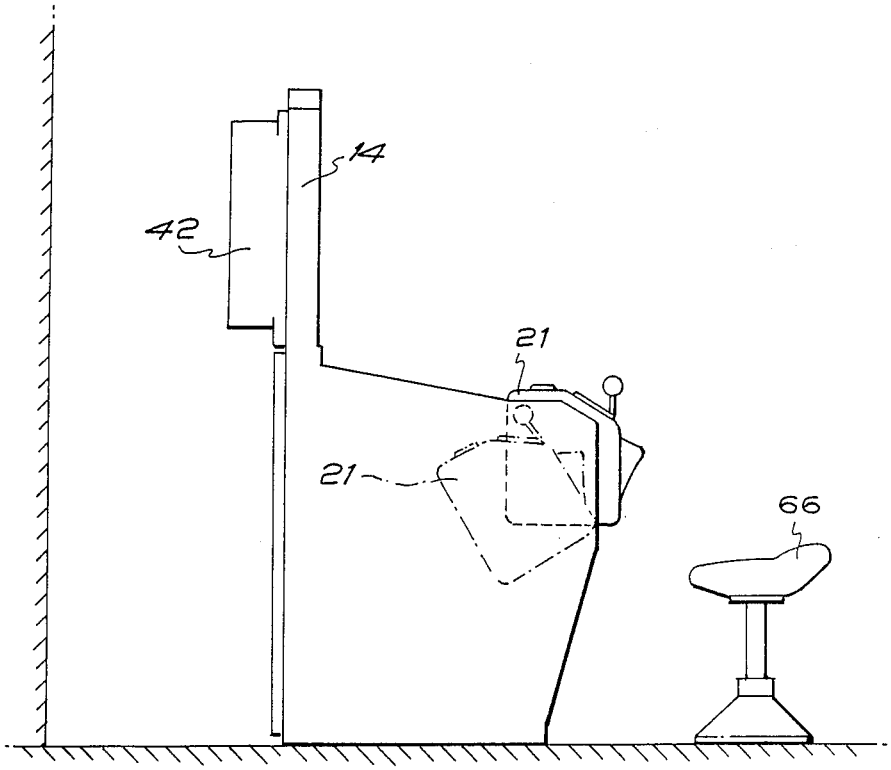
FIG. 2 is a side view of the machine, showing how a seat may be used therewith.

To the front and top of the casing 10 is provided a random number display assembly of which the handle 16 is the operating means. This assembly, which is referenced 21 can as shown in FIG. 2 be inserted into position from the rear of the casing 10, and it is provided with a display window 19 through which a pair of spin reels 22 and 24 arranged side by side can be viewed. It also has a coin insertion slot 20 for the receipt in one embodiment of a single denomination coin, typically 10p to provide one play of the machine, or in an alternative embodiment for the receipt of different denomination coins for example 10p, 20p, 50p and 100p to give 1, 2, 5 or 10 plays accordingly. The unit 21 has three buttons 26, 28 and 30 as indicated for controlling the operation of the spin discs as will be explained hereinafter.

In the front of the casing 10 there is a reject coin tray 32 in which a reject coin may be caught. The unit 21 has an instruction panel 33 providing instructions for the play of the machine, and also indicating the number of tokens to be won when particular arrangements of members are illuminated.

Under the matrix 15 is the rear panel 14 is a row of display panels 56 displaying the numerals 1 to 7 in this example, because for each play of the machine the player can operate the handle seven times. The respective areas 56 are illuminated in turn as the player proceeds through the seven operations of the handle 16 so that he will be aware of the number of operations which remain during any particular play.

Further display areas 34 on the unit 21 and 38 at the top of the display panel 15 provide indications of:

(a) The number of plays remaining when the machine is capable of accepting coins to give multi plays (b) When there is a coin error (c) When the hopper which dispenses winning tokens is empty and (d) When there has been an overpayment of tokens.

It might be noted at this time that in the event of any of events (b), (c) and (d), the machine automatically stops and gives an audible warning that attention is required.

The tokens which are dispensed by the machine are dispensed through a slot 40 at the bottom front end of the panel 14.

The machine is mains power driven through a suitable transformer which is housed is a casing 42 to the rear of panel 14 as shown in FIG. 2, and casing 14 also houses a tokens dispensing hopper.

Tokens dispensed from slot 40 run down the transparent panel enclosing a case 17, and impact on a stop bar 42, which bar also has a curved channel for receiving the coins edge on. The channel is associated with a scale so that the user will be able to tell at a glance the number of tokens which he has in the channel.

Figure 3:
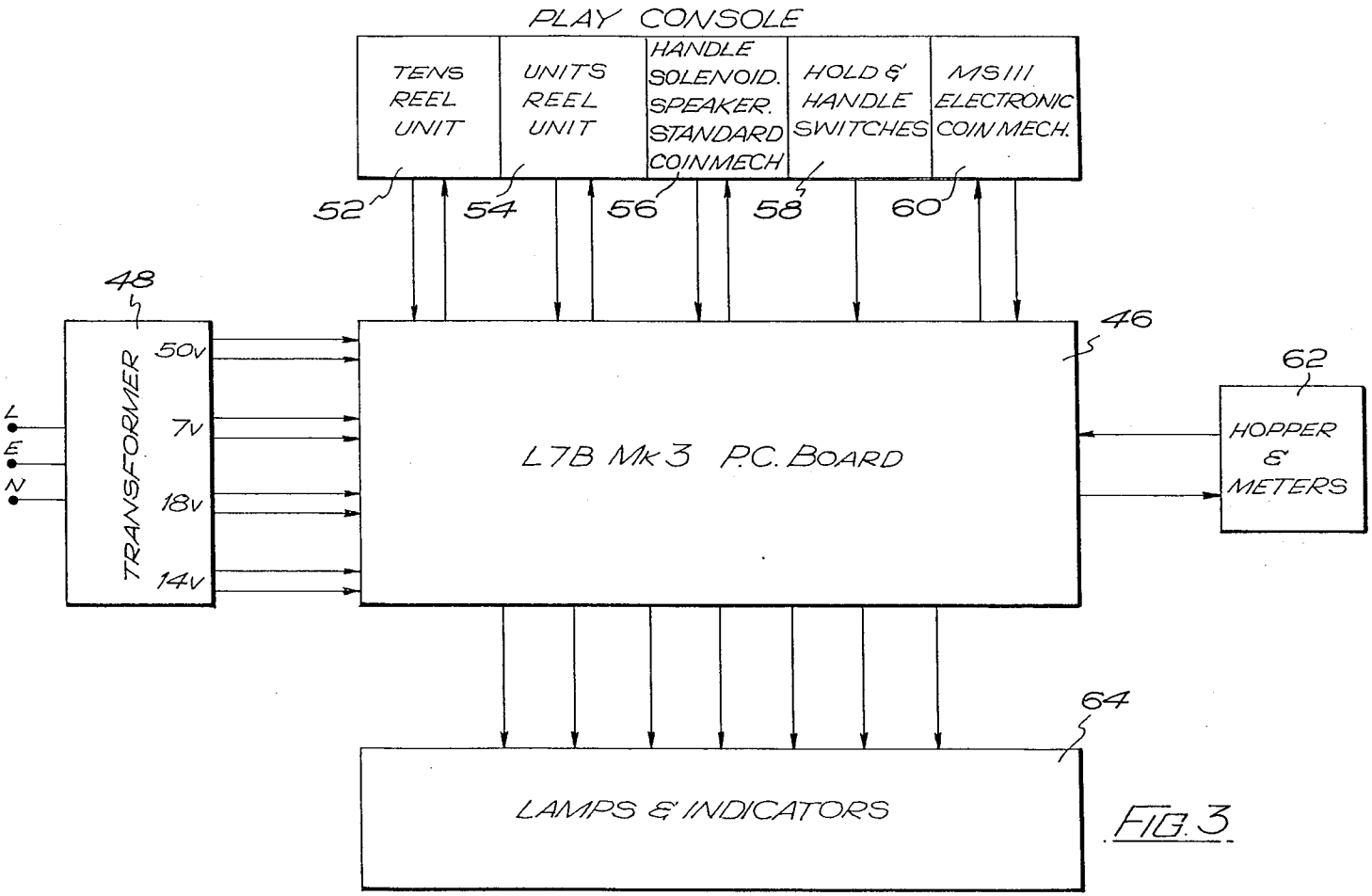
FIG. 3 is a block diagram showing logic control circuitry of the machine.

FIG. 3 indicated diagrammatically the control circuitry for the machine and it will be seen that the control circuitry is based upon a large printed circuit board type L7B Mark 3 and indicated by reference numeral 46. The transformer is indicated by numeral 48, whilst various logic units 52, 54, 56, 58 and 60 of the play console unit 21 are indicated and also indicated are logic circuits 62 for the hopper and are various meters of the machine, namely a meter for metering the number of coins inserted through slot 20, and also the number of tokens dispensed, and the logic circuit 64 for the various lamps and indicators of the machine.

FIG. 2 indicates furthermore that the machine may be used in conjunction with a seat 66 so that the player can be comfortable whilst playing the machine.

When the machine is non-operational, transformer 48 still feeds the control board 46, and certain lamps are illuminated by the logic circuit 64 to cause a sequence of illumination of the various numbers in the display matrix 15, and certain lights also flash in the console 21. This is simply to catch the eye of passers by. The machine may also be arranged to emit some sounds or music at this time.

When a coin is inserted in the slot 20 and is accepted setting the machine ready for play, all numbers of the display panel 15 are extinguished except the central number 33 which remains illuminated and is in fact given free to the player. A light behind area 1 of areas 36 flashes indicating that the player is on first actuation of handle 16. At the same time, lights flash in respect of buttons 26 and 28 indicating that either of the numbers displayed by the respective reels 22 and 24 may be held if desired.

Assuming that the player does not wish to hold either reel 22 or 24, he pulls handle 16 thereby to cause spinning of the reels in conventional fashion. When the reels stop, the number displayed thereby is illuminated in the display matrix 15, and the actuation area 36 indicating actuation number 2 is illuminated, indicating to the player that he has already used one actuation of the seven actuations within each play.

At this time, the player may decide to hold one or other of the two reels 22 or 24 by actuation of the button 26 or 28. This will depend entirely upon whether it is tactically better to try for a horizontal line or a vertical line or the four corners, as these will in fact be in this example winning combinations. Assume for example that in the first pull of the handle 16 the number 12 is displayed by the random display reels 22 and 24. The number 12 will be illuminated in the display matrix. If the player wishes to try for the illumination of the top line of numbers in the display matrix, he would clearly hold reel 22 displaying the numeral 1 and spin only the second reel 24. If he does this, and numeral 2 once more appears on reel 24, then he has made more progress, but if the numeral 3 is displayed, then numerals 12 and 13 will be illuminated and he will continue playing using all seven actuations of the handle 16 in an effort to achieve illumination of numerals 11, 12, 13, 14 and 15. All numbers which are illuminated in one play of the machine remain illuminated until the end of such play.

The particular set out of the numerals on the board, i.e. selecting numerals 11 to 55, and using two reels with only numerals 1 to 5 thereon combined with the fact that seven pulls of the handle 16 are allowed for each player of the machine gives a good probability combination giving a reasonable chance of winning coupled with maintaining good excitement in the play of the machine.

It would be understood that the player can hold any reel at any particular time during a play of the machine.

With repeated plays, the player can accumulate large numbers of tokens which he can exchange for prizes displayed in the case 17. Trials with the machine described have shown it to be extremely successful.

The machine can be enhanced further by providing that buttons 26 or 28 are either hold buttons or skill stop buttons. This may require that actuation of a switch inside the machine to turn the buttons 26, 28 into skill stop buttons. When button 26 or 28 is a skill stop button, the player uses that button to stop the spinning of the reels and therefore he has some control over what number is displayed by each reel following each actuation of the handle 16. The machine may be set so that prior to each actuation of the handle 16 depression of the button 26 or 28 causes holding of the associated reel, but after the actuation of the handle 16, the button becomes a skill stop button which is operated as described above.

A typical pay out structure for the machine described may be as follows.

1. Illumination of the numbers of any horizontal or vertical or diagonal line equals ten tokens.
2. Illumination of one corner number equals pay out three tokens.
3. Illumination of two corner numbers equals pay out six tokens.
4. Illumination of three corner numbers equals pay out eight tokens.
5. Illumination of all four corner numbers equals pay out ten tokens.

Following pay out of tokens or at the end of a play if there is no pay out, the illumination of all numbers in the display matrix except number 33 will be cancelled.

After completion of play of the machine, the console circuit returns the machine to the lighting sequence and sound mode described herein for attracting the attention of passers by.

Although the number arrangement and spinning reel arrangement described herein provide a particularly advantageous machine, it should be mentioned that instead of using members, symbols or other means can be used. Additionally, it is not necessary to use spinning reels as a random number generating means, as other arrangements can be used.

In a modified arrangement, plurality of the machines are ganged as explained herein for play simultaneously and respectively by a plurality of players, the objective being that the players play against each other and the first player to achieve a particular combination of display numbers, say a line of numbers is the winner and will receive a prize or a plurality of tokens.

We claim:

1. An amusement machine comprising:

(a) actuator means for operating the machine, (b) random display means comprising first and second side-by-side display areas, first display means for displaying in the first of the areas one of a first set of symbols, and second display means for displaying in the second of the areas one of a second set of symbols wherein said first and second display means form a multi-character number;

(c) first connecting means operatively connecting the actuator means and random display means for operating the random display means upon actuation of the actuator means to cause the respective symbols of the first set and second set to be repeatedly and sequentially displayed in said first and second areas until stopped in accordance with the play of the machine;

(d) fixed display means comprising a matrix of indications each comprising two side-by-side symbols being a symbol of said first set and a symbol of the second set;

(e) second connecting means operatively connecting the random display means with the fixed display means for displaying in the fixed display means each indication comprising the two symbols of the first and second sets displayed in the said first and second display areas when the display means is operated and then stopped; and (f) control means for enabling the player selectively to control one of the first and second display means relative to the other so that a player can exercise control over the symbols which are displayed in the random display means in such a manner that either of the displayed characters can be held while the other character is allowed to randomly change.

2. A amusement machine according to claim 1, wherein the first set of symbols comprises the numerals 1 to 5 and the second set of symbols also comprises the numerals 1 to 5, and the fixed matrix indications comprise the numbers in horizontal rows as follows: 11 to 15; 21 to 25; 31 to 35; 41 to 45; and 51 to 55.

3. An amusement machine according to claim 2 wherein the random display means comprises two side-by-side rotatable drums having the numerals 1 to 5 on their peripheries.

4. An amusement machine according to claim 3: wherein said control means comprises (m) manually operated skill stop means; and (n) sixth means connecting the skill stop means and the random display means whereby the player can control the stopping of the first display means or the second display means.

5. An amusement machine according to claim 3 wherein said central means comprises (g) hold means; and (h) third connecting means operatively connected to the hold means for holding either of said drums from spinning during an actuation of the random display means.

6. An amusement machine according to claim 5 including:

(j) a coin operated mechanism for receiving a coin to commence play of the machine;

(k) multiple actuation means for permitting multiple actuation of the machine during each play; and (l) fourth means connecting the actuator and multiple actuation means permitting multiple actuation of the random display means during each play of the machine.

7. An amusement machine according to claim 6 wherein said multiple actuation means is set to give seven actuations of the machine during each play.

8. An amusement machine according to claim 7 including actuation indicator means to indicate the number of actuations remaining for each play of the machine.

9. An amusement machine according to claim 6 wherein the control number 33 in the matrix is given free in each play of the machine.

10. An amusement machine according claim 6 including:

(o) token pay out means; and (p) seventh means connecting the token pay out means and the fixed matrix whereby at the end of each play if a winning number combination is displayed tokens are dispensed to the player from the token pay out means.

11. An amusement machine according claim 10 including:

(q) a display case containing prizes which can be won;

(r) a downwardly and forwardly sloped transparent cover closing the top of said case;

said pay out means being located so that tokens dispensed therefrom run down the transparent cover towards the player; and (s) a stop bar at the lower end of the cover to stop the running down of the tokens.

* * * * *